United States Patent [19]

Chapman

[11] Patent Number: 5,016,505

[45] Date of Patent: May 21, 1991

[54] SPRING RETURN MECHANISM FOR FLYING SHEARS

[76] Inventor: Ward W. Chapman, 2700 W. Third Ct., Hialeah, Fla. 33010

[21] Appl. No.: 450,415

[22] Filed: Dec. 14, 1989

[51] Int. Cl.[5] ..... B26D 1/60

[52] U.S. Cl. ..... 83/198; 83/320; 83/588; 83/638

[58] Field of Search ..... 83/196, 198, 310, 314, 83/318, 320, 588, 638

[56] References Cited

U.S. PATENT DOCUMENTS

| | | | |
|---|---|---|---|
| 968,196 | 8/1910 | Reeder | 83/638 |
| 4,179,962 | 12/1979 | Crump | 83/638 |
| 4,394,829 | 7/1983 | Stoehr | 83/314 |

FOREIGN PATENT DOCUMENTS

| | | | |
|---|---|---|---|
| 2526151 | 12/1976 | Fed. Rep. of Germany | 83/198 |

*Primary Examiner*—Hien H. Phan

*Attorney, Agent, or Firm*—Charles J. Prescott

[57] ABSTRACT

A spring return mechanism for returning the movable blade and connected slide plate to their at rest position in a flying shear. The device is positioned outboard of the movable and fixed blades, each of which has mating and alignable apertures through which long lengths of stock material to be sheared into shorter segments are continuously fed. Each device includes an upright elongated spring housing, a compression spring acting within the housing, and a guide button which moves up and down within the housing to return the slide plate and connected movable blade back to their at rest position immediately after each shearing. The guide button has an upper end which allows the slide plate to move or slide diagonally downward against the guide buttons following the diagonal motion of the movable blade during each cutting cycle.

2 Claims, 1 Drawing Sheet

Fig. 3
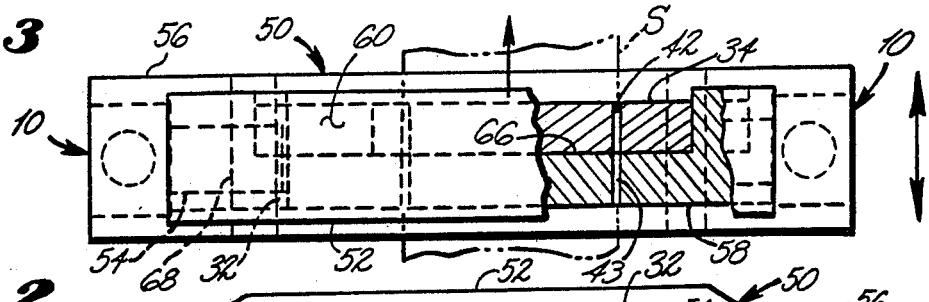
Fig. 2
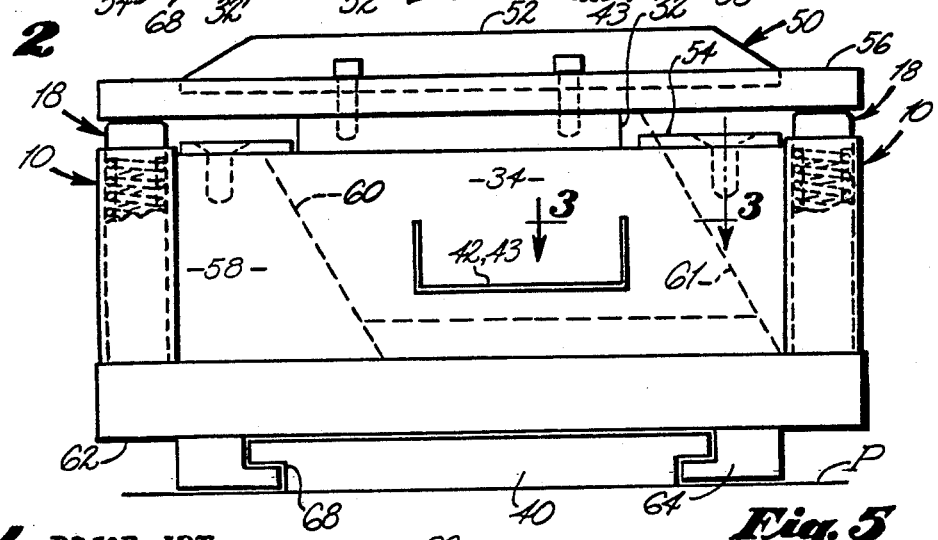
Fig. 1- PRIOR ART
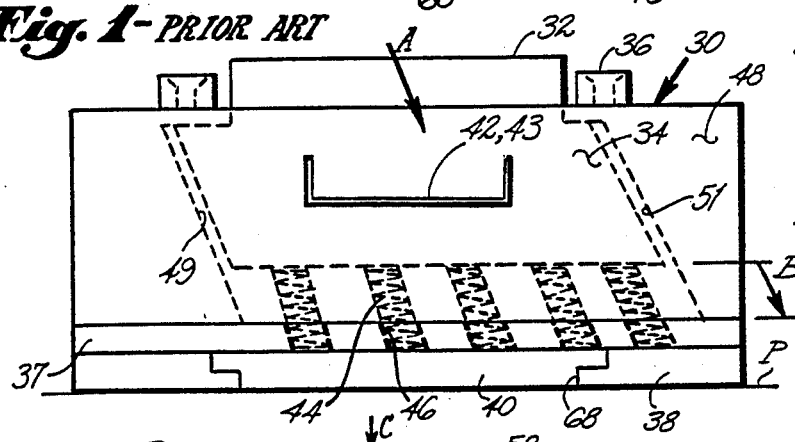
Fig. 5
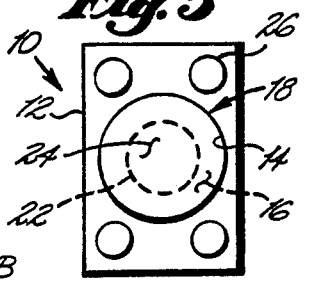
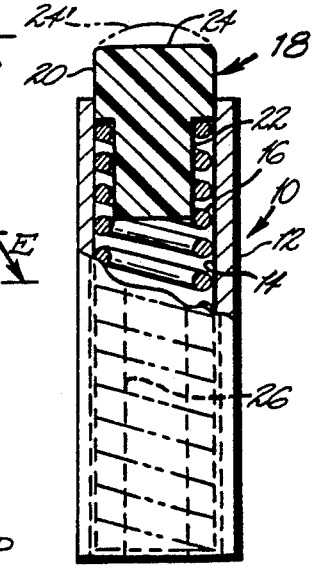
Fig. 4
Fig. 6
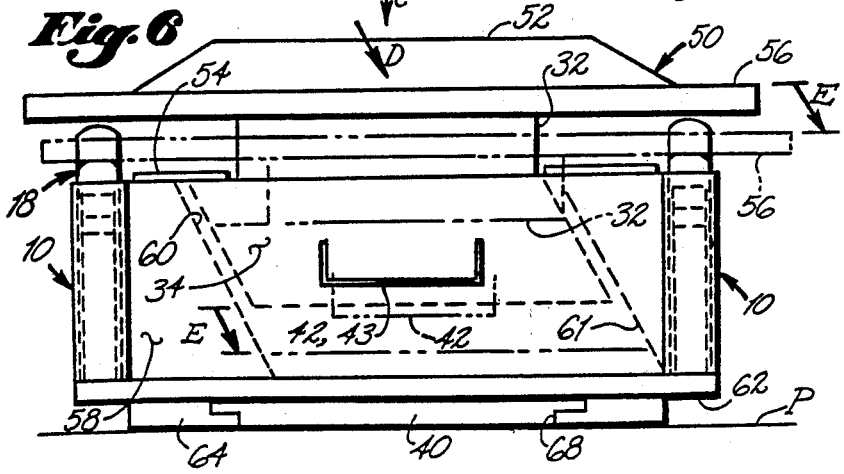

SPRING RETURN MECHANISM FOR FLYING SHEARS

BACKGROUND OF THE INVENTION

This invention relates generally to flying shears, and more particularly to an improved spring return mechanism for flying shears.

Flying shears are well-known in the art of metal fabrication and handling. A detailed description of such device is shown in FIG. 1 and more fully described herebelow. These flying shears are generally adapted to shear long or continuous lengths of stock material into shorter segments at high volume. The stock material is in continuous longitudinal motion through mating apertures in the movable and stationary blades of the flying shear. When the movable blade is activated to effect shearing, the entire flying shear mechanism is transported by the moving stock a short distance during the shearing operation and then returned longitudinally to its original position.

Because of the great demand placed on flying shears, the timing for returning the movable blade back up to its at rest position wherein the stock material may continue to feed longitudinally through the aligned apertures in both movable and stationary blades is quite short. A battery of conventional coil or compression springs acting in tandem or parallel are normally utilized beneath the lower horizontal margin of the movable blade to quickly return the movable blade to its at rest position.

Technology now dictates that the movable blade act in its downward motion at a diagonal angle to the length of the stock material so as to effect a higher quality and more effective shearing action of the stock material. Thus, the conventional spring return system beneath the movable blade in the form of the battery of compression springs is typically disposed at the same diagonal angle (typically 60° to horizontal) as is the movement of the movable blade.

This conventional battery of compression springs quickly wears because of the extremely abusive environment in which they act. Of course, once the battery of springs has lost strength and effectiveness, the entire flying shear must be disassembled by removing the movable blade for replacement of these coil compression springs.

The present invention provides an easily serviceable and considerably more reliable and durable spring return mechanism for use in conjunction with these flying shears. In fact, applicant has found in experimentation that the present invention will last as many as 100 times longer than the conventional battery of return springs used in flying shears.

BRIEF SUMMARY OF THE INVENTION

This invention is directed to a spring return mechanism for returning the movable blade and connected slide plate to their at rest position in a flying shear. The device is positioned outboard of the movable and fixed blades, each of which has mating and alignable apertures through which long lengths of stock material to be sheared into shorter segments are continuously fed. Each device includes an upright elongated spring housing, a compression spring acting within the housing, and a guide button which moves up and down within the housing to return the slide plate and connected movable blade back to their at rest position immediately after each shearing. The guide button has an upper end which allows the slide plate to move or slide diagonally downward against the guide buttons following the diagonal motion of the movable blade during each cutting cycle.

It is therefore an object of this invention to provide an improved spring return mechanism for flying shears which is substantially more durable and reliable than conventional return spring systems.

It is another object of this invention to provide the above spring return device for use in conjunction with both existing and newly manufactured flying shears.

In accordance with these and other objects which will become apparent hereinafter, the instant invention will now be described with reference to the accompanying drawings.

BRIEF DESCRIPTION OF THE DRAWINGS

FIG. 1 is an end elevation view of a conventional prior art flying shear.

FIG. 2 is an end elevation view of a flying shear having the invention installed therein.

FIG. 3 is a top plan view of FIG. 2 showing a broken section view in the direction of arrows 3—3 in FIG. 2.

FIG. 4 is a vertical section view of the invention.

FIG. 5 is a top plan view of FIG. 4.

FIG. 6 is an end elevation view of a flying shear die having the invention installed therein and depicting movement in phantom during shearing.

DETAILED DESCRIPTION OF THE INVENTION

Referring now to the drawings, and particularly to FIG. 1, a conventional flying shear is there shown generally at numerally 30. Reference may also be made to FIG. 3 with respect to the general structure of the flying shear components and the relationship of the movable and stationary blades described herebelow. The conventional flying shear 30 includes an upper block 32 rigidly connected or integral atop the movable blade 34. (The sliding plate 56 and slap block 52 shown in FIGS. 2, 3 and 6 which are positioned above the upper block 32, are not shown in FIG. 1.)

The movable blade 34 is held adjacent and against fixed or stationary blade 48 within diagonal guide surfaces 49 and 51 so that the movable blade 34 moves in the direction of arrow A. Both movable and stationary blades 34 and 48 respectively, include mating and aligning apertures 42 and 43, respectively. These apertures 42 and 43 are sized to receive the cross sectional shape of a particular length of stock to be sheared. Disposed beneath the movable blade 34 are a plurality or battery of compression springs 44 each disposed in a mating cavity 46 within base plate 37. The base plate 37 slidably rests atop track 40 and is mounted for longitudinal translation atop track 40 within guide rails 38 disposed on either side thereof. Track 40 is connected atop press base P.

Retainer plates 36, connected atop stationary blade 48, provide an upper stop against movable blade 34 whereby the battery of compression springs 44 upwardly move the movable blade 34 within guide surfaces 49 and 51 against these retainer plates 36 to the at rest position of movable blade 34. In its at rest position of movable blade 34, apertures 42 and 43 of movable and stationary blades 34 and 48, respectively, are aligned one to another to allow the length of stock material having a similar cross section to be freely moved longitudinally therethrough.

Thus, as upper block 32 of movable blade 34 is repeatedly driven diagonally downward in the direction of arrow A during each shearing of stock passing through aligned apertures 42 and 43, the battery of compression springs 44 is required to return the movable blade 34 back upward against retainer plates 36 to the at rest position.

During the time that apertures 42 and 43 are misaligned and shearing is occurring, the length of stock to be sheared continues to move. To accommodate this continued stock movement, base plate 37 is also made movable longitudinally on track 40 within guide rails 38. A control system for insuring controlled back and forth longitudinal motion of base plate 37 in this fashion (not shown) is also included within these conventional flying shear systems.

Referring now to FIGS. 2 to 5, the preferred embodiment of the invention is shown generally at numeral 10 as best seen in FIGS. 4 and 5 positioned as shown within modified flying shear 50. One of these devices 10 is positioned in upright orientation adjacent the ends of the mating movable and stationary blades 34 and 58. The stationary blade 58 is connected in upright fashion atop base plate 62, again made movable by sliding guide rails 64 along track 40. Alternately, one device 10 may be positioned at each corner of stationary blade 58.

Each spring return mechanism 10 includes an elongated housing 12 having a longitudinal cylindrical aperture 14 into which compression spring 16 is fitted. Positioned atop compression spring 16 is a guide button 18 having enlarged upper diameter 20 and a smaller lower diameter 22. Guide button 18 is fabricated preferably of DELRIN or other suitable material and may include either a flat upper surface 24 or a domed upper surface shown in phantom at 24' . The spring housing 12 is mounted in upright fashion atop base plate 62 whereby slide plate 56 mounted atop the upper block 32 of movable blade 34 is fully supported atop guide buttons 18.

A slap block 52 is also provided connected atop slide plate 56 which serves to receive the downward impact of a press to downwardly drive movable blade 34 to effect shearing of the stock materials along surface 66 as best seen in FIG. 3.

Referring additionally to FIG. 6, the slide plate 56 is driven diagonally downwardly in the direction of arrow D a distance shown at arrow E by downward vertical impact by a press in the direction of arrow C atop slap block 52. Thus, as movable blade 34 is also downwardly moved a distance E within diagonal guide surfaces 60 and 61, slide plate 56 must move laterally with respect to guide buttons 18. Because the guide buttons 18 are secured within spring housing 12 around the larger upper diameter 20 so as to resist lateral force, the slide plate 56 may easily move diagonally downwardly as shown in phantom in FIG. 6 without undue distress either upon guide button 18 or compression spring 16. Sliding movement required between the top surface 24 or 24' of guide button 18 and the lower surface of slide plate 56 is facilitated by the use of DELRIN or the like in the guide button 18.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. In a flying shear having an upright stationary blade connected atop a horizontal base plate and a diagonally movable upright cutting blade slidably mounted against said stationary blade, each of said blades having longitudinal apertures which are alignable and matable one to another when said movable blade is in its at rest position, each of said apertures which, when aligned one to another, longitudinally slidably sized to receive a continuous length of stock material for longitudinal passage therethrough, and a horizontal slide plate connected above said movable blade for receiving a downward force to momentarily drive said movable blade diagonally downward from its at rest position whereby said mating apertures are moved out of alignment to sheer the stock material each time said movable blade is driven downwardly, said base plate horizontally translatable back and forth on a press base during sheering of the stock material whereby the movement of the stock material is uninterrupted, the improvement comprising:

an upright return spring mechanism positioned on either side of said stationary and movable blades, said return spring mechanism including an elongated spring housing, a guide button, and a compression spring;

said return spring mechanism upwardly acting between said slide plate and said base plate to return said slide plate upwardly back to its at rest position after said slide plate is struck;

said compression spring within each said spring housing supportively positioning said guide button to extend above the upper end of said spring housing and said guide button spring biasingly translatable vertically within each said spring housing above and against said compression spring;

said guide button having an upper surface freely permitting said diagonal downward movement and return of said slide plate to the at rest position.

2. In a flying shear having an upright stationary blade connected atop a horizontal base plate and a diagonally movable upright cutting blade slidably mounted against said stationary blade, each of said blades having longitudinal apertures which are alignable and matable one to another when said movable blade is in its at rest position, each of said apertures which, when aligned one to another, longitudinally slidably sized to receive a continuous length of stock material for longitudinal passage therethrough, and a horizontal slide plate connected above said movable blade for receiving a downward force to momentarily drive said movable blade diagonally downward from its at rest position whereby said mating apertures are moved out of alignment to sheer the stock material each time said movable blade is driven downwardly, said base plate horizontally translatable back and forth on a press base during sheering of the stock material whereby the movement of the stock material is uninterrupted, the improvement comprising:

upright spring biasing means connected to and upwardly extending from said base plate and positioned on either side of said stationary and movable blades for supporting said slide plate in an at rest position wherein said mating apertures are aligned one to another and for spring biasingly returning said slide plate upwardly to its at rest position after being driven downwardly to sheer the stock material;

the upper ends of said spring biasing means freely permitting laterally sliding translation of said slide plate back and forth during downward diagonal movement of said movable cutting blade and return to the at rest position of said slide plate.

* * * * *